US008777677B2

(12) United States Patent
Pade et al.

(10) Patent No.: US 8,777,677 B2
(45) Date of Patent: Jul. 15, 2014

(54) ELECTRICAL CONTACT FOR PLUG-IN CONNECTIONS

(75) Inventors: Wolfgang Pade, Illingen (DE); Peter Rehbein, Thuengersheim (DE)

(73) Assignee: Robert Bosch GmbH, Stuttgart (DE)

( * ) Notice: Subject to any disclaimer, the term of this patent is extended or adjusted under 35 U.S.C. 154(b) by 112 days.

(21) Appl. No.: 13/516,075

(22) PCT Filed: Oct. 18, 2010

(86) PCT No.: PCT/EP2010/065616

§ 371 (c)(1),
(2), (4) Date: Sep. 12, 2012

(87) PCT Pub. No.: WO2011/072909

PCT Pub. Date: Jun. 23, 2011

(65) Prior Publication Data

US 2013/0040506 A1 Feb. 14, 2013

(30) Foreign Application Priority Data

Dec. 15, 2009 (DE) ..... 10 2009 054 705

(51) Int. Cl.
*H01R 13/432* (2006.01)

(52) U.S. Cl.
USPC ..... 439/748; 439/595; 439/751

(58) Field of Classification Search
USPC ..... 439/748, 476, 749, 595, 751, 744, 852
See application file for complete search history.

(56) References Cited

U.S. PATENT DOCUMENTS

| | | | | |
|---|---|---|---|---|
| 3,581,271 | A | 5/1971 | Knitter et al. | |
| 4,306,761 | A | 12/1981 | Ress | |
| 6,165,026 | A | 12/2000 | Sugie et al. | |
| 6,655,997 | B2 * | 12/2003 | Lam et al. | 439/746 |
| 7,217,161 | B1 * | 5/2007 | Tyler et al. | 439/748 |
| 8,591,271 | B2 * | 11/2013 | Bies | 439/852 |

FOREIGN PATENT DOCUMENTS

| | | |
|---|---|---|
| CN | 1138224 | 12/1996 |
| DE | 198 12 935 | 10/1998 |
| JP | H 03-147282 | 6/1991 |
| JP | 2002-134206 | 5/2002 |

* cited by examiner

*Primary Examiner* — Hae Moon Hyeon
(74) *Attorney, Agent, or Firm* — Kenyon & Kenyon LLP

(57) ABSTRACT

In an electrical contact for plug-in connections, in particular for the direct contacting of contact surfaces of a circuit board, the contact having a contact housing which includes an inwardly deflectable primary lance, which outwardly projects beyond the contact housing, counter to the insertion direction, for retaining the contact inserted into a contact chamber of a mating plug, the primary lance has a free end which is offset inwardly relative to its outwardly projecting lance section and extends counter to the insertion direction, which free lance end is outwardly overlapped by a housing stop of the contact housing.

10 Claims, 2 Drawing Sheets

ELECTRICAL CONTACT FOR PLUG-IN CONNECTIONS

FIELD OF THE INVENTION

The present invention is based on an electrical contact for plug-in connections, in particular for the direct contacting of contact surfaces of a circuit board.

BACKGROUND INFORMATION

Electrical plug-in connections are employed to establish a releasable electrical connection between, for instance, an electrical line and another electrical line, or an electrical line and an electrical aggregate, by way of the socket part or the male connector of the plug-in connection. In a plug-in connection between the electrical contact of a line (cable tree side) and a control unit (component side), a primary lance is used to reliably retain the electrical contact of the line in a contact chamber of a component-side cable tree plug over the service life.

FIGS. 1*a* and 1*b* show a known electrical contact 101 for the direct contacting of contact surfaces 102 of a circuit board 103. Electrical contact 101 has a contact housing 104, which is integrally molded from a sheet metal part and inserted, in insertion direction 105, into a contact chamber of a mating plug (not shown) provided on circuit board 103. Contact housing 104 includes a primary lance 106, which projects outwardly, counter to insertion direction 105, and is deflectable toward the inside, in order to retain contact 101 inserted into the contact chamber of the mounting plug on a back taper of the contact chamber. On the side lying opposite from primary lance 106, contact housing 104 has an outwardly projecting contact lamella 117 for the electrical contacting of contact surface 102.

However, in such known plug-in connections the problem may arise that the holding force of the electrical contact in the contact chamber of the cable tree plug of the primary lance is too low and that the primary lance is dislodged in an outward direction in the event of excessive loading.

SUMMARY OF THE INVENTION

According to the exemplary embodiments and/or exemplary methods of the present invention, the primary lance is overlapped on the outside by a housing projection and supported on the contact housing (contact body) in this way. Under loading, the primary lance is therefore unable to be dislodged in the outward direction quite as easily. Due to this overlapping of the primary lance at the contact housing, the holding force of the primary lance in the contact chamber of the cable tree plug is increased considerably. No additional component is required for the greater primary holding force; the sheet metal dimensions of the contact housing are not enlarged by the housing projection and thus do not cause any additional expense. Due to the fact that the primary lance is resting against the housing projection, current is transmitted here as well. Furthermore, mechanical jamming of the contact during processing at the manufacturer in the region of the primary lance is reduced considerably.

In contrast to electrical contacts, in which the free end of the primary lance has always been sharp-edged and the contact frequently caught when it was uninstalled from the contact chamber, the free lance end, which in the exemplary embodiments and/or exemplary methods of the present invention may be bent at a radius, prevents the primary lance from getting stuck in the contact chamber during disassembly of the primary lance. During the disassembly, the primary lance is pressed inwardly with the aid of a disassembly tool, and the contact is pulled toward the rear at its electrical line and completely removed from the contact chamber in this manner. Disassembly is necessary, for example, if a cable manufacturer has inserted an electrical contact into the wrong contact chamber and the contact must be reinserted into the correct contact chamber. During the assembly or disassembly of the electrical contact according to the present invention through a seal or sealing mat, it will not be damaged by the primary lance, and the sealing function of the cable tree plug is retained.

Further advantages and advantageous embodiments of the subject matter of the present invention are derivable from the description and the drawings.

In the following text, the exemplary embodiments and/or exemplary methods of the present invention are elucidated in greater detail on the basis of an exemplary embodiment shown in the drawing in highly schematic form.

DETAILED DESCRIPTION

Figure 1A:
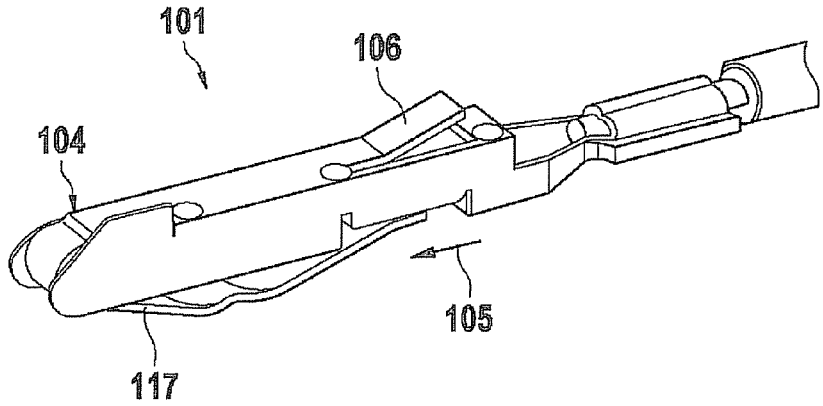
Fig. 1a (Prior Art)
FIG. 1*a* shows an electrical contact of a plug-in connection for the direct contacting of a circuit board according to the related art, in a perspective view.
Figure 1B:
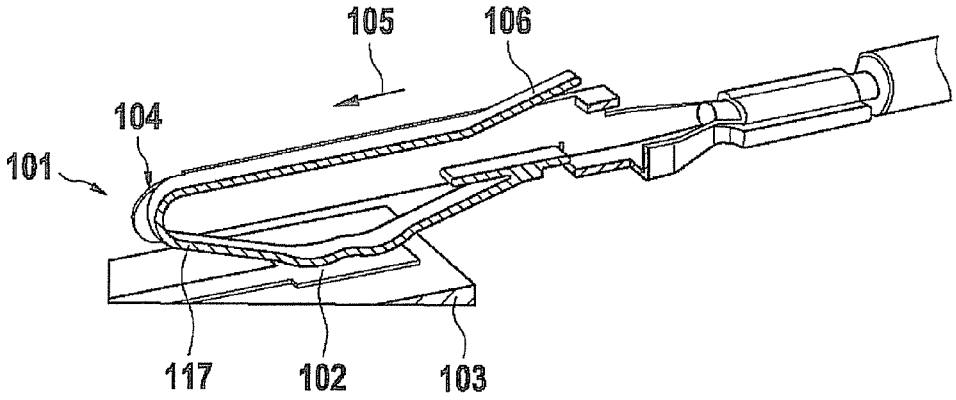
Fig. 1b (Prior Art)
FIG. 1*b* shows an electrical contact of a plug-in connection for the direct contacting of a circuit board according to the related art, in a longitudinal section.
Figure 2:
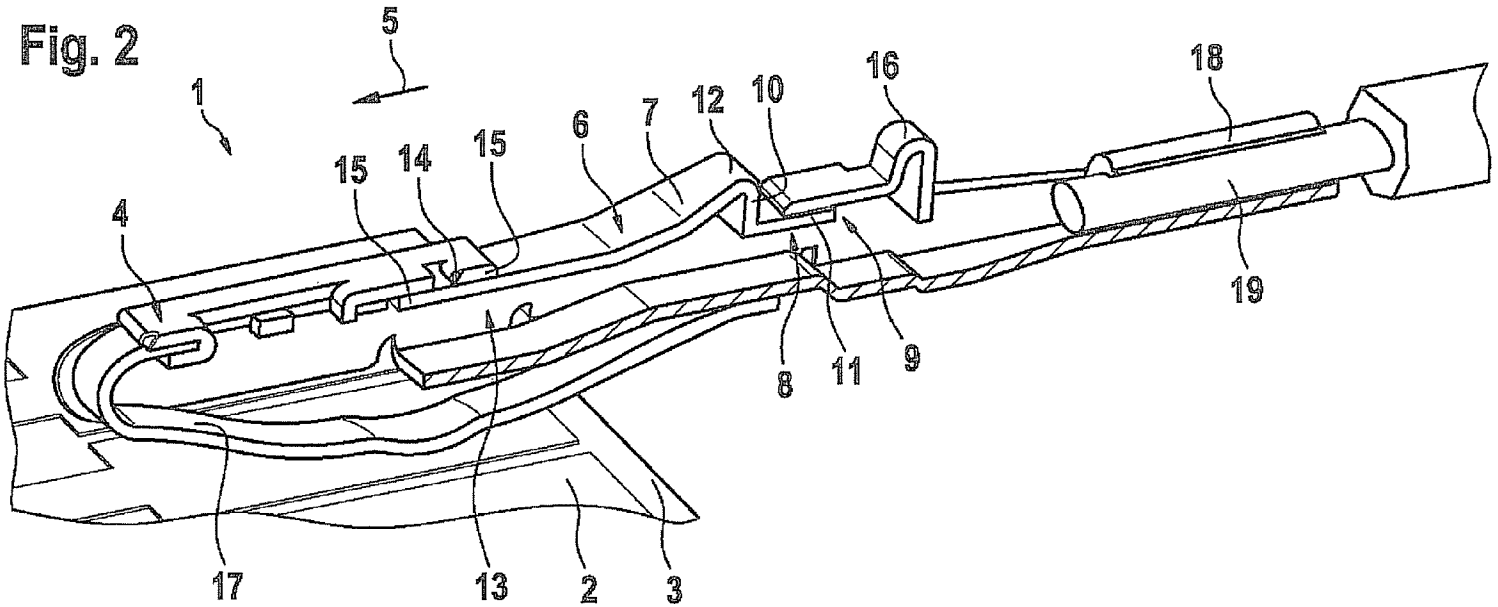
FIG. 2 shows an electrical contact of a plug-in-connection according to the present invention for the direct contacting of a circuit board, in a longitudinal section.

Electrical contact 1 according to the present invention, shown in FIG. 2, is used for the direct contacting of contact surfaces 2 of a circuit board 3.

Electrical contact 1 has a contact housing (contact body) 4, which is formed in one piece from a sheet metal part, which contact housing is inserted in insertion direction 5 into a contact chamber of a mating plug (not shown) provided on circuit board 3.

Contact housing 4 includes a primary lance 6, which has an inwardly deflectable lance section 7 which projects outwardly, counter to insertion direction 5, in order to retain contact 1 inserted into the contact chamber of the mating plug at a back taper of the contact chamber. Primary lance 6 has a free lance end 8 which is offset inwardly in comparison with lance section 7 which projects outwardly, and the free lance end extends counter to insertion direction 5, the free lance end being overlapped on the outside by a housing stop 9 of contact housing 4 and resting against it, possibly with prestressing.

Free lance end 8 is formed at a right angle by an inner angle leg 10, which, starting at the outwardly projecting lance section 7, is bent towards the inside, i.e., at a right angle to the longitudinal axis of contact 1, and by an external angle leg 11, which extends counter to insertion direction 5. Transition 12 from outwardly projecting lance section 7 to inner angle leg 10 is rounded at a radius. Fixed lance end 13 of primary lance 6 is formed by two mutually overlapping sheet metal layers 15 of contact housing 4 which are welded to each other at 14. That is to say, primary lance 6 is connected to contact housing 4 on one side, is overlapped once and welded. Primary lance 6 is additionally supported in itself by angular free lance end 8. Housing stop 9 is formed by a bent tab of contact housing 4, whose free end extends in insertion direction 5 and is welded to contact housing 4 on both sides in order to increase stability. Primary lance 6 is resting against this tab via its external angle leg 11. At its fixed end, housing stop 9 has a segment 16, which is bent outwardly in the form of a U, to form a stop for a secondary locking mechanism (not shown) of contact 1 inserted into the contact chamber of the mating plug.

For the electrical contacting of contact surface 2 of circuit board 3, the front plug end of contact housing 4 is surrounded by a U-shaped contact lamella 17, which is fixed in place on contact housing 4 and projects outwardly beyond contact housing 4 on the housing side situated opposite from primary lance 6. Contact lamella 17 is welded to contact housing 4 at its two ends, in electrically conductive manner.

Contact housing 4 additionally has a crimp segment 18, where line 19 of electrical contact 1 is mounted so as to be electrically conductive.

Since housing projection 9 overlaps primary lance 6 on the outside and is supported thereon, primary lance 6 is unable to be dislodged toward the outside even under high loading. Due to this overlap of primary lance 6 at the housing projection 9, the holding force of primary lance 6 within the contact chamber of the cable tree plug is increased considerably. Since primary lance 6 abuts on housing projection 9, current is transmitted here too, which current is able to flow from the contact point of contact lamella 17 on contact surface 2, via contact lamella 17 and contact housing 4, to primary lance 6 and from there, via housing projection 9, to electrical line 19.

What is claimed is:

1. An electrical contact for a plug-in connection, including for directly contacting contact surfaces of a circuit board, comprising:

a contact housing having an inwardly deflectable primary lance, which projects beyond the contact housing in the outward direction, counter to the insertion direction, so as to retain the contact inserted into a contact chamber of a mating plug;

wherein the primary lance has a free lance end which is inwardly offset in relation to an outwardly projecting lance section of the primary lance and (ii) extends counter to the insertion direction, and wherein the free lance end is overlapped on the outside by a housing stop of the contact housing.

2. The electrical contact of claim 1, wherein the free lance end rests against the housing stop.

3. The electrical contact of claim 1, wherein the free lance end is formed at an angle by an inner angle leg, which is inwardly bent starting at the outwardly projecting lance section, and an external angle leg, which extends counter to the insertion direction.

4. The electrical contact of claim 1, wherein the transition from the outwardly projecting lance section to the free lance end, as to the inner angle leg, is rounded.

5. The electrical contact of claim 1, wherein the primary lance includes a fixed lance end which is at an opposite end of the primary lance from the free lance end, and wherein the fixed lance end of the primary lance is formed by two mutually overlapping and welded sheet metal layers of the contact housing.

6. The electrical contact of claim 1, wherein the housing stop is formed by a bent tab of the contact housing, whose free end extends in the insertion direction and is mounted on the contact housing.

7. The electrical contact of claim 1, wherein the housing stop has at its fixed end a segment, which is bent outwardly in the form of a U, to form a stop for a secondary locking mechanism of the contact inserted into the contact chamber of the mating plug.

8. The electrical contact of claim 1, wherein a contact lamella is provided for the electrical contacting of a contact surface of the mating plug.

9. The electrical contact of claim 8, wherein the contact lamella projects outwardly beyond the contact housing on the housing side of the contact housing lying opposite from the primary lance, for the electrical contacting of the contact surface of the mating plug.

10. The electrical contact of claim 8, wherein the contact lamella is fixed in place, in particular welded or soldered, at one end or at both ends on the contact housing so as to be electrically conductive.

* * * * *